US005620104A

United States Patent [19]

Maglione

[11] Patent Number: 5,620,104

[45] **Date of Patent: *Apr. 15, 1997**

[54] COLLAPSIBLE PEG DISPLAY STAND

[76] Inventor: Stephen T. Maglione, 15 Ava Maria Ct., Millington, N.J. 07946

[ * ] Notice: The term of this patent shall not extend beyond the expiration date of Pat. No. 5,522,574.

[21] Appl. No.: 394,466

[22] Filed: Feb. 27, 1995

[51] Int. Cl.[6] ..... A47F 5/00

[52] U.S. Cl. ..... 211/59.1; 211/57.1; 211/189; 248/174; 248/220.41

[58] Field of Search ..... 211/87, 189, 59.1, 211/57.1, 72, 73; 248/174, 220.31, 220.41

[56] References Cited

U.S. PATENT DOCUMENTS

| | | | |
|---|---|---|---|
| 1,886,532 | 11/1932 | Davidson | 248/174 X |
| 1,902,566 | 3/1933 | Marsh . | |
| 3,341,162 | 9/1967 | Ruchlis | 248/174 |
| 3,433,365 | 3/1969 | Hodson . | |
| 3,494,479 | 2/1970 | Martin . | |
| 3,871,608 | 3/1975 | Ogden . | |
| 4,311,233 | 1/1982 | Austin . | |
| 4,550,839 | 11/1985 | Good . | |
| 4,671,417 | 6/1987 | O'Brien . | |
| 4,687,128 | 8/1987 | White . | |
| 4,724,967 | 2/1988 | Valiulis . | |
| 4,733,782 | 3/1988 | Spezial et al. . | |
| 4,813,536 | 3/1989 | Willis . | |
| 4,860,905 | 8/1989 | Schott et al. . | |
| 4,949,851 | 8/1990 | Shaffer . | |
| 5,213,220 | 5/1993 | McBride . | |
| 5,273,169 | 12/1993 | Maglione . | |
| 5,277,388 | 1/1994 | Denaro . | |
| 5,305,875 | 4/1994 | Meyer . | |
| 5,465,851 | 11/1995 | Smith | 248/174 X |
| 5,522,574 | 6/1996 | Maglione | 248/220.31 X |

*Primary Examiner*—Robert W. Gibson, Jr.

[57] ABSTRACT

A triple thickness T-shaped corrugated paperboard display peg board with discrete apertures in a front panel and aligned slots in a rear panel and insert is supported by a pair of triangular supports also of triple thickness. The supports and board each comprise folded over sheets and an insert bonded together. The supports are interlocked with the display board with aligned slots. A brace member also folded over corrugated paperboard has slots interlocked with the supports also with mating interlocking slots. The base of the board is narrower than the upper portion and has edges flush against the supports which are interlocked to the upper portion. The display board has peg receiving apertures comprising discrete apertures in a front panel and aligned with slots in the insert and rear panel.

20 Claims, 4 Drawing Sheets

FIG. 2
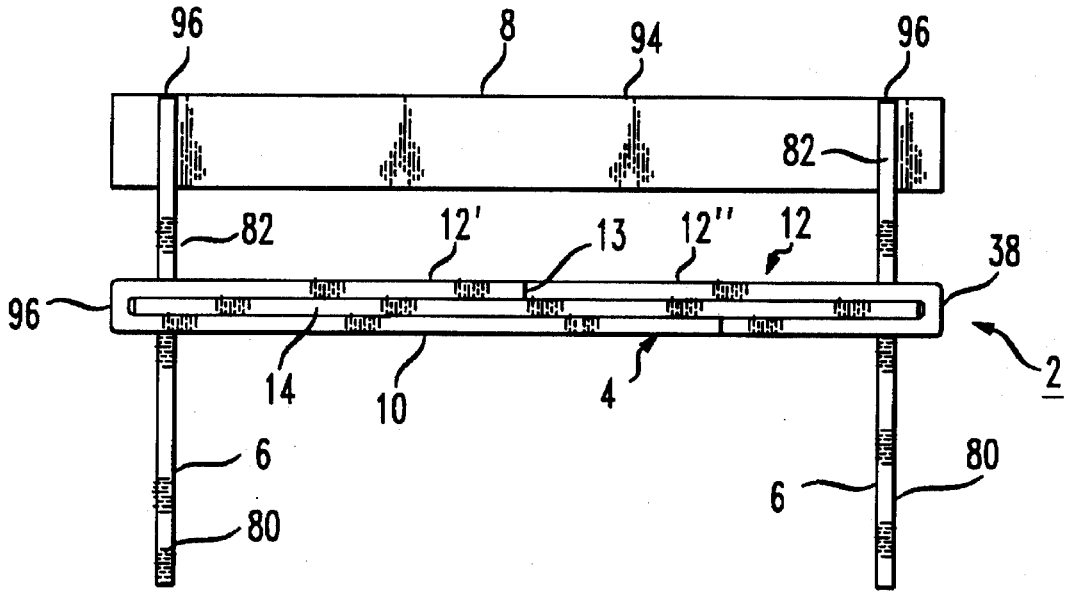
FIG. 3
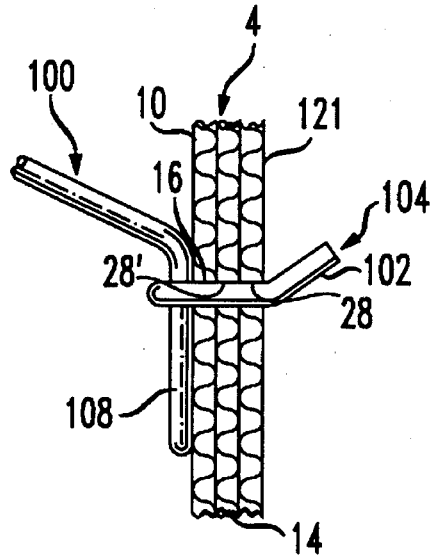
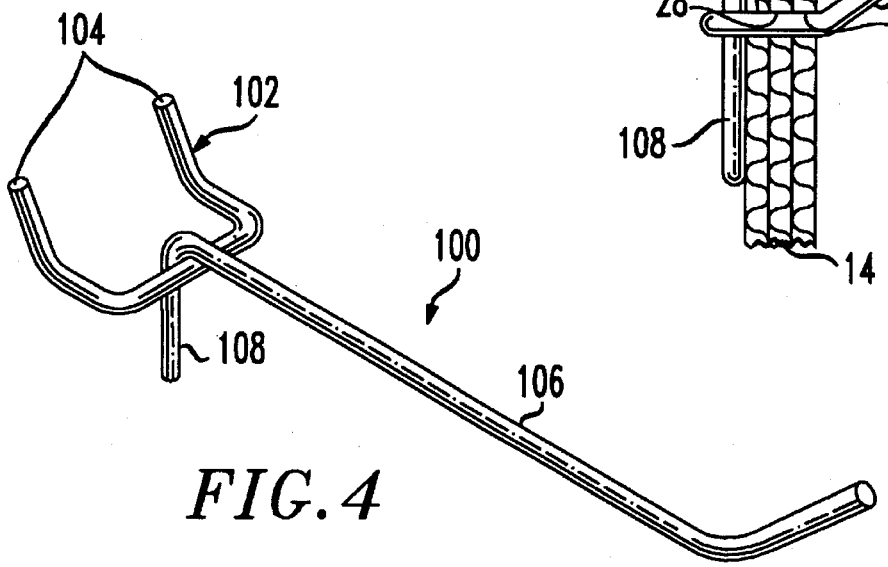
FIG. 4

COLLAPSIBLE PEG DISPLAY STAND

This invention relates to collapsible display stands, and more particularly, to peg type paperboard stands.

Of interest is copending application of the present inventor Ser. No. 291,129 entitled Collapsible Display Stand filed Aug. 14, 1994.

Peg type displays are in wide use. See for example, U.S. Pat. Nos. 3,871,608; 4,724,967; 4,733,782; 4,550,839 and 4,671,417 by way of example. Collapsible stands are also known. See for example U.S. Pat. Nos. 5,277,388; 4,949,851; 5,213,220 and 4,550,839. These types of displays are typically designed for specific display purposes. Stands may be fabricated of multiple pieces and or from a single sheet of paperboard. See U.S. Pat. No. 5,277,388 and the above-noted copending application for a stand comprising a single sheet of paperboard, for example. See others of the above patents for multiple piece stands.

Some are relatively complex. See for example U.S. Pat. No. 5,213,220 and others relatively simple such as U.S. Pat. No. 3,871,608. The present inventor recognizes a need for a simple display stand that is readily adapted for counter display and is attractive in appearance.

A collapsible peg board display stand for displaying articles on at least one peg secured to the display stand according to the present invention comprises a planar display board having a plurality of article display peg receiving apertures therethrough, the board having a front and a rear side. First and second planar supports are releasably interlocked to the board in spaced relation to each other, an edge of each support and an edge of the board being coplanar for supporting the stand. A transverse brace member is coupled to and between the supports for securing the supports in the fixed spaced relation.

In one embodiment, the brace member is rectangular and generally planar and secured normal to the supports and facing the rear side spaced from the stand supporting edges.

In a second embodiment, the supports are triangular and identical, the supports extending beyond the front and rear sides.

In a further embodiment, the display board has a top edge and a bottom edge and a first pair of opposing edges and second pair of opposing edges, the first and second pairs of edges all extending in generally the same direction in spaced relation toward the top and bottom edges, each support being flush against a different one edge of the first pair and interlocked with the display board spaced from a different one edge of the second pair.

In a further embodiment, the second edges define a first transverse width and the first edges define a second transverse width smaller than the first width.

BRIEF DESCRIPTION OF THE DRAWING

FIG. 2 is a plan view of the stand of FIG. 1;

FIG. 3 is a sectional fragmented view of the stand of FIG. 1 illustrating a display peg attached to the display board;

FIG. 4 is an isometric view of a representative peg of the embodiment of FIG. 3;

Figure 1:
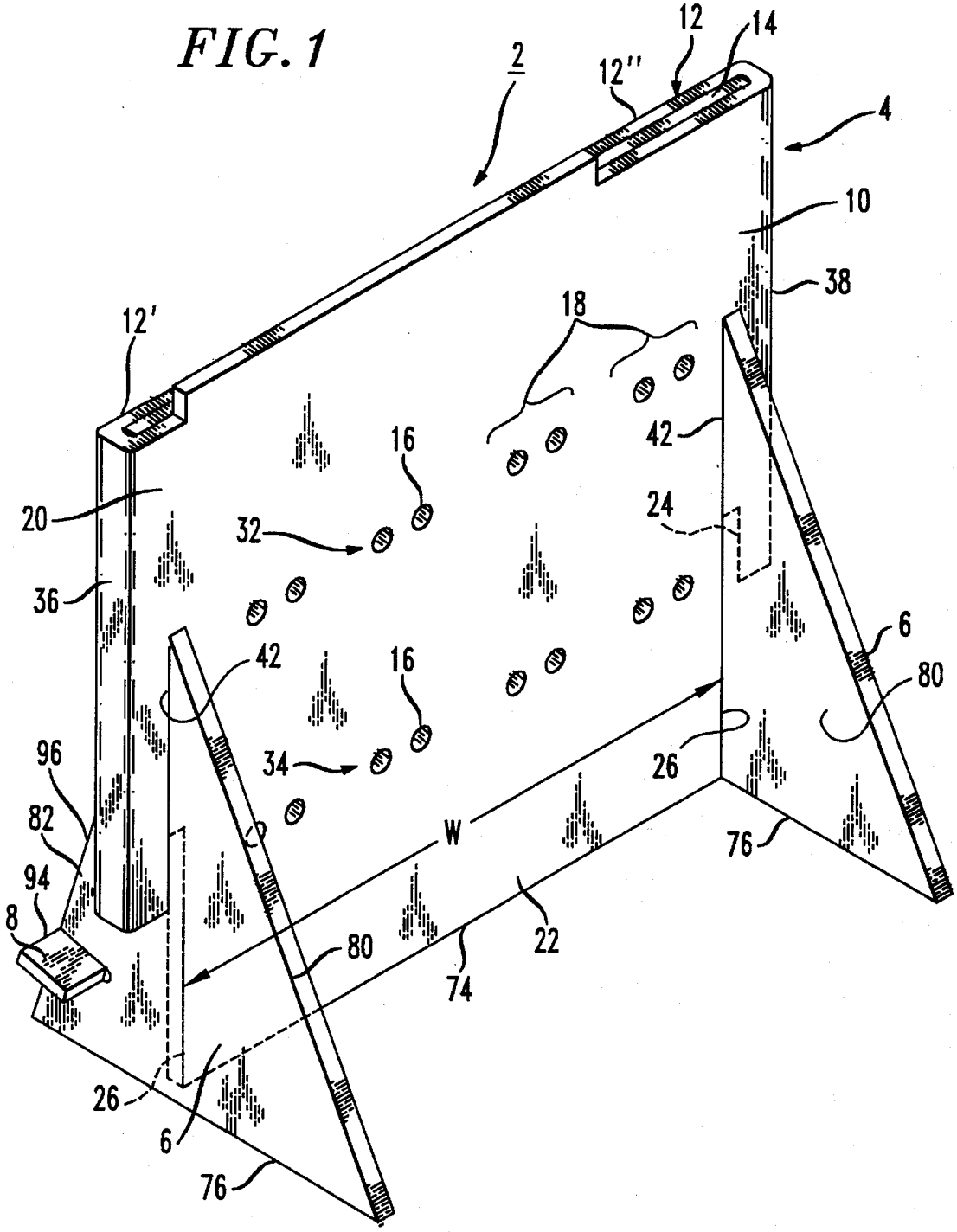
FIG. 1 is an isometric view of the stand according to the present invention.

In the Figures, display stand 2 comprises a display board 4, a pair of identical, preferably triangular, supports 6 and a brace member 8. The display board 4 comprises a front panel 10, a rear panel 12 and a reinforcing insert 14, all preferably corrugated sheet paperboard of the same single ply thickness. Other paperboard, such as stiff single ply non-corrugated sheets or multiple corrugated sheets may also be used in the alternative. A plurality of discrete separate peg receiving apertures 16 are in the display board 4. The apertures are arranged in arrays 18 of aperture pairs. There are two linear horizontal arrays of pairs 18 of apertures 16. These aperture arrays are by way of example and other array arrangements may be provided as desired.

Figure 11:
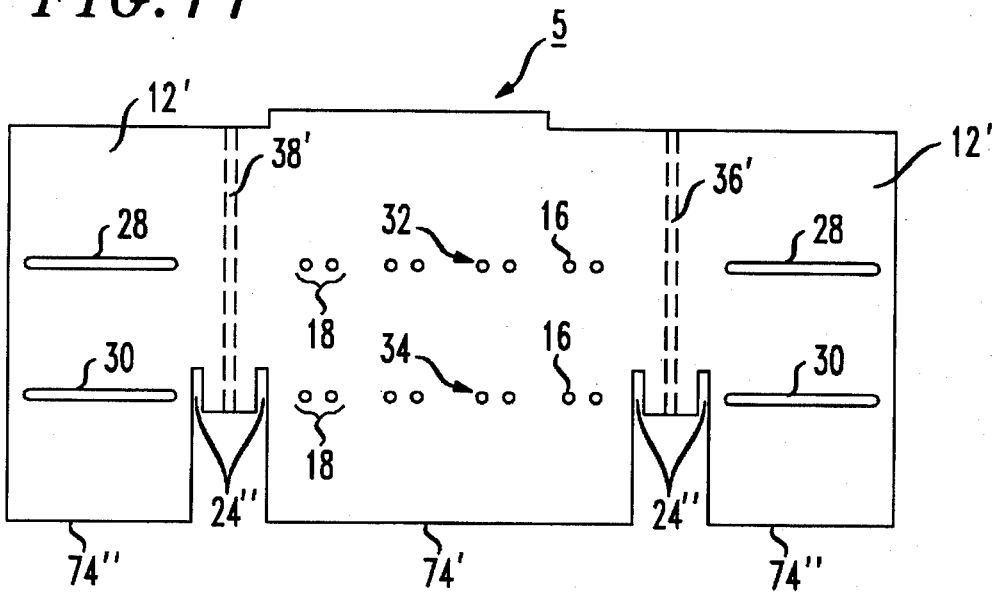
FIGS. 11, 12, 13 and 14, are respective plan views of the display board, support, display board insert and support insert blanks.

The board 4 is T-shaped having a wider upper portion 20 and a narrower lower portion 22 of width w. A slot 24 is formed in mirror image fashion on each side of the board 4 coextensive with a side edge 26 of lower portion 22. The rear panel 12 has slits or slots 28 and 30. Slots 28 are aligned in a linear array with the discrete apertures 16 of the upper array 32, FIG. 1. The slots 30 are aligned in a linear array with the discrete apertures 16 of lower aperture array 34. In FIG. 11, the board 4 is formed from a blank 5. In the blank 5, slots 24 are formed by slots 24" in the front panel 10 and in the rear panels 12' and 12". Slots 24" align to form slots 24 when the front and rear panels overlie one another when folded (FIG. 1) at fold lines 36' and 38' forming folds 36 and 38, respectively.

Figure 13:
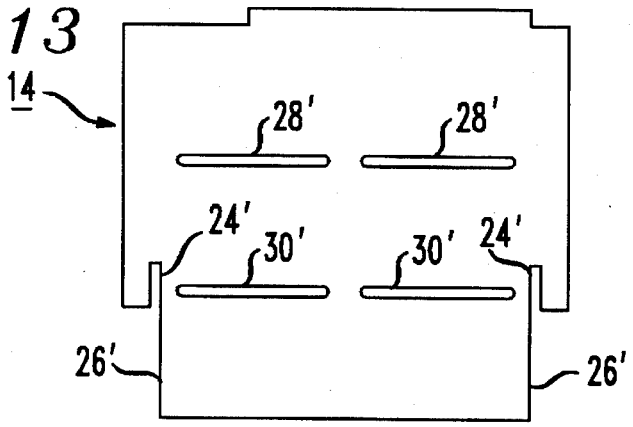

The insert 14, FIG. 13, is preferably a single ply sheet and has the same peripheral shape as the display board 4. The insert 14 fits between the rear panel 12 and front panel 10 of board 4. The insert 14 has slots 28' and 30' which are the same dimensions as and align with the respect slots 28 and 30 of the rear panel 12. The insert 14 also has slits or slots 24' which are the same dimensions as and are aligned with slots 24 of the board 4. The insert 14 has edges 26' which are coextensive with edges 26 of the front and rear panels 10 and 12, respectively.

The rear panel 12 comprises two sections 12' and 12" which are attached to the front panel 10 at folds 36 and 38, respectively, dashed lines 36' and 38', FIG. 11 The panels 12' and 12" when folded over form a seam 13. The panels 10 and 12 and insert 14 are preferably fastened with an adhesive to form board 4.

Figure 8:
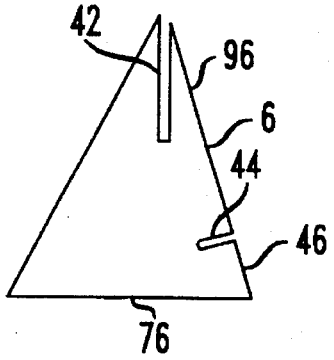
FIGS. 8 and 9 are respective plan views of a representative support and the brace member of the embodiment of FIG. 1.
Figure 12:
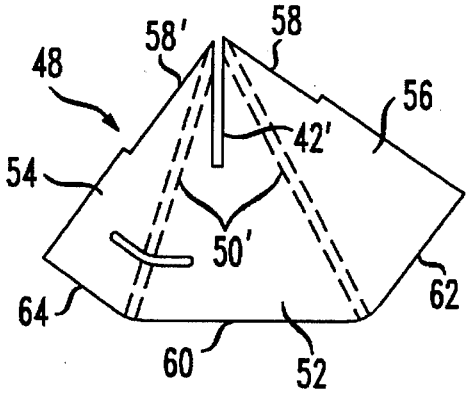

In FIG. 8, the supports 6 being identical, only one will be described. The support 6 is triangular and planar with an upper depending linear slot 42 and a second transverse shorter slot 44 in rear edge 46. In FIG. 12, the support 6 is formed from a blank 48. The dashed lines 50 form folds. The folds of lines 50 divide the support into a front triangular section 52 and two side sections 54 and 56. The front section has a slot 42' which forms slot 42, FIG. 8. A step 58, 58' in each section forms a slot aligned with slot 42' when the sections are folded over at lines 50. Edge 60 of section 52 forms a supporting edge of the support 6. Edges 62 and 64 of the sections 56 and 54, respectively, coincide with edge 60 when folded over.

Figure 14:
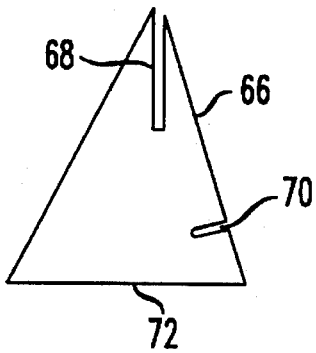

In FIG. 14, support insert 66 is the same shape as the support 6, FIG. 8, when in the folded over state. The insert 66 fits between the folded over sections 54 and 56 on one side and the section 52 on the other side of support 6. The insert is triangular and has an upper slot 68 which coincides with slot 42, FIG. 8, and a slot 70, which coincides with the slot 44. Edge 72 coincides with edge 60, FIG. 12. The insert 66 is bonded with an adhesive to the folded over sections 52, 54 and 56 (FIG. 12) of the support 6.

The supports 6 are assembled to the display board 4 by inserting a support 6 in each slot 24 of the display board with the plane of the planar support normal to the board. The support 6 is inserted further until its slot 42 receives and fully seats the board 4, FIG. 1. Thus, the supports are releasably interlocked with the board 4 by the board slots 24 and the support slots 42. The supports have a front triangular section 80 and a rear triangular section 82.

Figure 5:
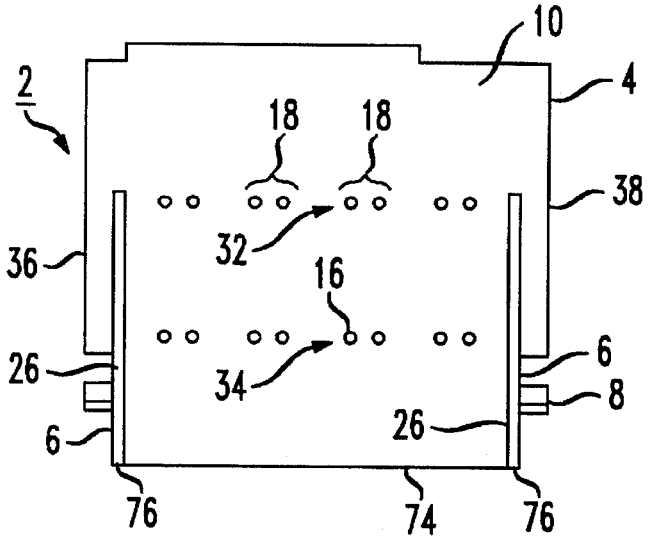
FIGS. 5, 6 AND 7 are respective front, side and rear elevation views of the stand of FIG. 1.
Figure 6:
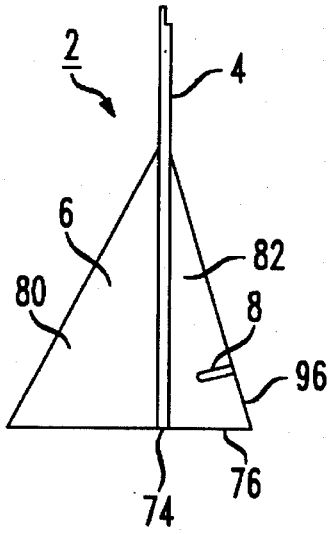
Figure 7:
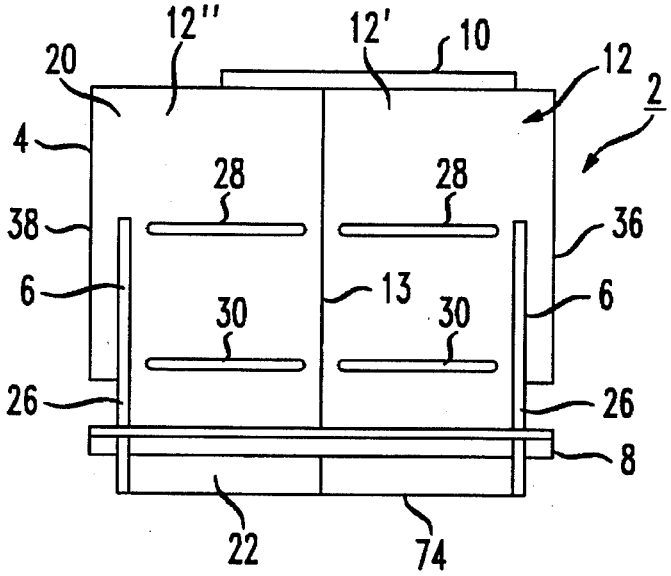

In FIGS. 1, 5 and 6, the lower edge 74 of display board 4 is coplanar with the lower edges 76 of supports 6. The edges 74 and 76 form a common coplanar support edge for the stand 2.

Figure 9:
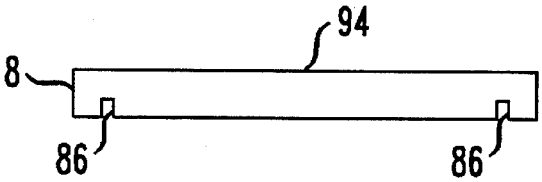
Figure 10:
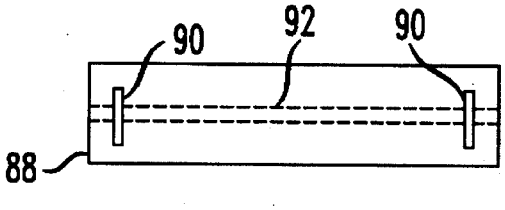
FIG. 10 is a plan view of the brace member of FIG. 9 showed in the blank stage prior to folding.

Rear brace member 8, FIG. 9, is elongated and rectangular. It has two spaced slots 86. The slots 86 are aligned with slots 44 of the supports 6. The slots 86 receive the support 6 and the slots 44 receive the brace member 8. This releasably interlocks the brace member 8 to the supports 6. In FIG. 10, the brace 8 is formed from blank 88. The blank 88 has two slots 90 and fold lines 92. The two halves formed by the lines 92 when folded over cause the slots 90 to each form a slot 86 at one edge of the member 8. Edge 94 of the brace member 8 is flush with the rear edges 96 of the supports 6.

The described display stand is easily assembled and disassembled by attaching the supports 6 to the display board 4 and the brace member 8 to the supports. The stand is sturdy and yet simple and pleasing in appearance. The display board receives appropriate sales indicia and artwork to finish the appearance.

In FIG. 4 a representative peg is shown. This is one example and other peg designs may be used. The peg 100 includes a bent U-shaped bracket 102 having legs 104. An article support rod 106 is attached to bracket 102 and has a depending leg 108.

In FIG. 3, peg 100 is assembled to a pair 18 of apertures 16, one being shown in this figure. The bracket 104 legs 102 are inserted in separate apertures 16 and the respective aligned slots 28 and 28' of the rear panel 12' and insert 14. Thus the peg is supported by a triple thickness of single ply corrugated sheets. This thickness provides durable support for articles supported on the peg 100.

It will occur to those of ordinary skill that modifications may be made to the disclosed embodiments given by way of illustration and not limitation. It is intended that the scope of the invention be defined by the appended claims.

What is claimed is:

1. A collapsible peg board display stand for displaying articles on at least one peg secured to the display stand, the stand comprising:

a planar T-shaped display board having a plurality of article display peg receiving apertures therethrough, said board having a front and a rear side;

first and second planar supports releasably interlocked to the board in spaced relation to each other, an edge of each support and an edge of the board being coplanar for supporting the stand; and a transverse brace member coupled to and between the supports for securing the supports in said fixed spaced relation.

2. The stand of claim 1 wherein the brace member comprises a double thickness folded sheet of material directly interlocked to the first and second supports and is generally rectangular in plan view, said brace member being secured normal to the supports and facing the rear side of said board spaced from the stand supporting edges.

3. The stand of claim 1 wherein the supports are triangular and identical, the supports extending beyond the front and rear sides, the supports each comprising a folded over sheet of material having at least a double thickness interlocked directly with the display board.

4. The stand of claim 1 wherein the display board has a top edge and a bottom edge and a first pair of opposing edges and second pair of opposing edges, the first and second pairs of edges all extending in generally the same direction in spaced relation toward the top and bottom edges, each support being flush against a different one edge of said first pair and interlocked with the display board spaced from a different one edge of the second pair.

5. The stand of claim 4 wherein the second edges define a first transverse width and the first edges define a second transverse width smaller than the first width.

6. The stand of claim 4 wherein said first and second pairs of edges define a T-shaped display board.

7. The stand of claim 1 wherein the board has a height and first and second different transverse widths each between opposing corresponding edges forming approximately a T-shaped periphery and having a lower portion of said first transverse width between corresponding opposing edges and an upper wider portion of said second transverse width between corresponding opposing edges, said supports each being secured interlocked to said upper portion flush with a different one of said edges of said lower portion.

8. The stand of claim 1 wherein the board comprises a folded over sheet of paper board forming a front sheet and a rear sheet overlying the front sheet, the front sheet having a plurality of discrete apertures therethrough, the rear sheet having a slot aligned with said discrete apertures.

9. The stand of claim 8 including a paperboard insert sheet between said front and rear sheets, said insert sheet having a slot therethrough aligned with the slot in the rear sheet.

10. The stand of claim 1 wherein the supports each comprises a folded over paperboard sheet having a slot therein, said display board having a pair of spaced slots therein, each board slot being interlocked with a different support and each support slot being interlocked with the board.

11. The stand of claim 1 wherein the supports are each flush with a different opposing edge of a first portion of the board and interlocked with a second portion of the board.

12. The stand of claim 1 wherein the supporting edges form an H-shape in plan view.

13. The stand of claim 1 wherein the board, supports and brace member are all folded over corrugated paper board.

14. A paper board collapsible peg display stand comprising:

A T-shaped planar paper board display board having an upper portion of wider transverse width than a lower portion and including peg receiving apertures; and a pair of planar paper board supports, each interlocked with the display board adjacent an edge of the upper and the lower portions, the supports and board each having a support edge, said support edges being coplanar.

15. The display stand of claim 14 further including a brace member interlocked with the supports.

16. The display stand of claim 15 wherein the board brace member and supports are folded over corrugated paper board, the board having a front sheet with an array of discrete apertures and a rear sheet with at least a slit aligned with the array of apertures.

17. A paper board collapsible peg display stand comprising:

a paper board display board having an array of peg receiving apertures, said board having a lower edge for supporting the board; and a pair of like triangular paper board supports each releasably interlocked to the display board in spaced relation to each other and to the display board, each support having an edge coplanar with the lower edge of the display board for supporting the display board; and a brace member interlocked with the supports and spaced from the coplanar edges.

18. The stand of claim 17 wherein the display board is T-shaped with opposing lower and upper edges forming respective upper and lower transverse display board portions, the upper portion being wider than the lower portion, each support being flush against a different lower edge on a side of the board and interlocked with the wider upper portion spaced from a corresponding upper edge.

19. The stand of claim 17 wherein the display board comprises a front sheet and a rear sheet, the front sheet having said apertures, the rear sheet having a first slit aligned with the apertures, and an insert sheet between the front and rear sheets, the insert sheet having a further slit aligned with said apertures and first slit.

20. The stand of claim 17 wherein the display board comprises a front sheet and a rear sheet, the front sheet having said apertures, the rear sheet having a slot aligned with the apertures.

* * * * *